US005810347A

United States Patent [19]

Wingate

[11] Patent Number: 5,810,347

[45] Date of Patent: Sep. 22, 1998

[54] APPARATUS FOR GRIPPING AND CONVEYING SHEET-LIKE PRODUCTS

[75] Inventor: Mark Anthony Wingate, Rochester, N.H.

[73] Assignee: Heidelberger Druckmaschinen AG, Heidelberg, Germany

[21] Appl. No.: 346,168

[22] Filed: Nov. 21, 1994

[51] Int. Cl.[6] ..... B65H 29/04

[52] U.S. Cl. ..... 271/204; 271/277

[58] Field of Search ..... 271/204, 206, 271/277

[56] References Cited

U.S. PATENT DOCUMENTS

| | | | |
|---|---|---|---|
| 2,773,585 | 12/1956 | Caulfield | 271/204 X |
| 4,320,894 | 3/1982 | Reist et al. | 271/204 X |
| 4,424,965 | 1/1984 | Faltin | 271/204 X |
| 4,498,664 | 2/1985 | Reist . | |
| 4,505,378 | 3/1985 | Statkus | 271/204 X |
| 4,566,687 | 1/1986 | Faltin . | |
| 4,953,847 | 9/1990 | Honegger | 271/277 |
| 4,982,944 | 1/1991 | Eberle | 271/204 |
| 5,042,792 | 8/1991 | Honegger et al. . | |
| 5,178,262 | 1/1993 | Merkli et al. | 271/204 X |
| 5,395,151 | 3/1995 | Eberle | 271/277 X |

*Primary Examiner*—F. J. Bartuska
*Attorney, Agent, or Firm*—Kenyon & Kenyon

[57] ABSTRACT

An apparatus for gripping and conveying sheet-like products includes a single or multiple conveying tracks for supporting a gripping device, or a series of gripping devices linked in the form of a chain. The gripping device has a support moving within or along a conveying track. The gripping device engages sheet-like products, and includes at least two grippers which are actuatable independently from one another. The grippers allow different portions of the sheet-like products to be conveyed to different locations.

18 Claims, 5 Drawing Sheets

APPARATUS FOR GRIPPING AND CONVEYING SHEET-LIKE PRODUCTS

BACKGROUND OF THE INVENTION

1. Field of the Invention

The present invention relates to an apparatus for gripping and conveying sheet-like products, such as sheets, signatures, newspapers, periodicals, or the like.

2. Discussion of the Prior Art

U.S. Pat. No. 4,566,687 discloses a conveying system for transferring newspapers or the like from a moving belt to a series of clamps. In this apparatus, shingled papers are conveyed on a horizontally extending belt and are then seized by clamps continuously moving at a constant transit speed lower than the speed of the belt. Each individual paper is gripped and conveyed in a substantially vertical direction by the clamps.

U.S. Pat. No. 4,498,664 shows an apparatus for removing, from a product stream on a conveyor, flexible flat products, especially printed products. The printed products are conveyed in an imbricated formation, and are bent in a substantially saddle-shaped fashion. The printed products are seized by clamps in a middle portion of the saddle shape. A release of some of the printed products conveyed in a shingled formation causes downward movement of products being gripped into one location.

U.S. Pat. No. 5,042,792 discloses a process and an apparatus for conveying printed products. In a take-over region, the succession of printed products is changed from a first imbricated formation to a second imbricated formation. This changes the product formation during conveying and allows for single product take-up by a clamping device of each product.

SUMMARY OF THE INVENTION

It is an object of the present invention to allow for release of at least two commonly seized products at different release points.

It is a further object of the present invention to simplify the delivery of two side-by-side product streams.

It is another object of the invention to minimize the number of components used in constructing the device, in order to achieve delivery of products at different points.

Finally, it is an object of the present invention to combine the product-releasing options of a two-track conveying system into a single-track conveying system.

In order to implement these and still further objects of the present invention, the apparatus for gripping and conveying sheet-like products of the present invention has: a single conveying track or multiple conveying tracks supporting a gripping device, the gripping device having a support moving within said single conveying track or multiple conveying tracks, gripper devices which seize slit sheet-like products, and gripper devices which are independently actuatable.

The support of the gripping devices may be either slidably mounted on a single conveying track or may contact rotatable guiding devices within the conveying track. The gripping devices are divided in half lengthwise and each of the gripper devices on either side of each gripping device has an actuating element. The actuating element can be a cam interacting with a cam follower, although other arrangements are also possible. Actuation of the cam follower by the cam overcomes a spring force, which spring force maintains the gripper device closed and therefore maintains pressure between the gripper and a corresponding pad.

The gripper devices include a first gripper and second gripper cooperating with a first pad and a second pad, respectively. The first cam follower and a first lever arm are mounted on a first axle of the support, and the second cam follower and a second lever arm are mounted on a second axle of the support. The first and second axles are mounted coaxially within the support of the gripping device.

Furthermore, the first and second axles define the pivoting axes about which the first and the second grippers move, thereby seizing a sheet-like product. The single conveying track or multiple conveying tracks can either extend in a substantially horizontal plane or can be inclined relative to a horizontal plane. Sheet-like products are held between a gripper and a corresponding pad by a spring force. The cam follower and lever arm are actuated by a cam which overcomes the spring force exerted on the gripper.

BRIEF DESCRIPTION OF THE DRAWINGS

The foregoing and other features of the present invention will become apparent to those skilled in the art, upon reading the following description of preferred embodiments of the invention, in view of the accompanying drawings, wherein.

DESCRIPTION OF PREFERRED EMBODIMENT

Figure 1:
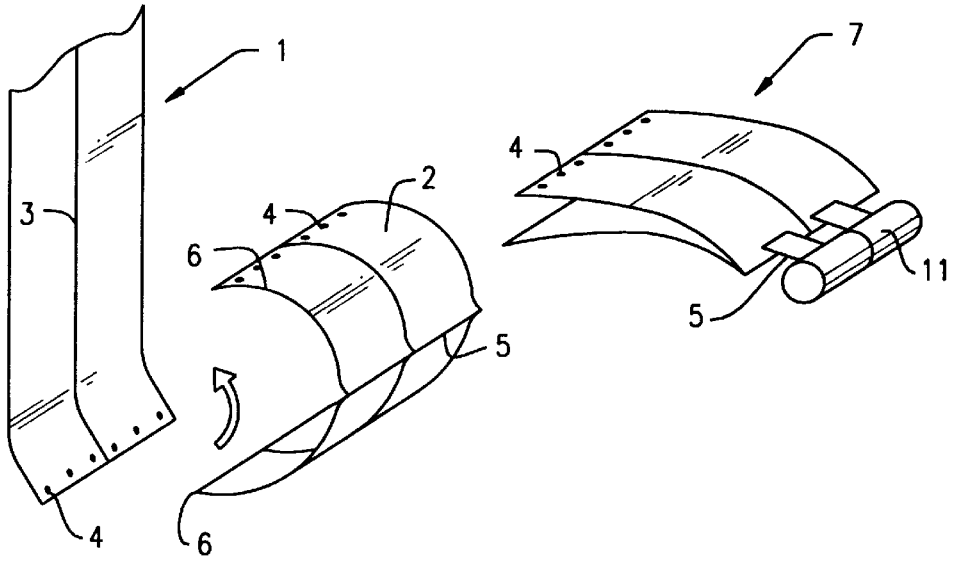
FIG. 1 shows a slit ribbon configuration for tabloid folds in a side-by-side arrangement.

FIG. 1 shows a ribbon configuration 1 entering the cylinder part of a folder apparatus. The ribbon 1 has a longitudinally extending slit 3 and is cut into signatures 2. Pin holes 4 are located on the front edge of the ribbon 1. The cut signatures 2 have a trailing edge 6 with pin holes 4 and leading edge 5 which is the first parallel fold made in the folding mode. The product emerging from this folding mode is of a tabloid type 7. The signatures 2 folded in the folding mode have a longitudinal slit 3 dividing the signatures 2 into two portions.

Figure 2:
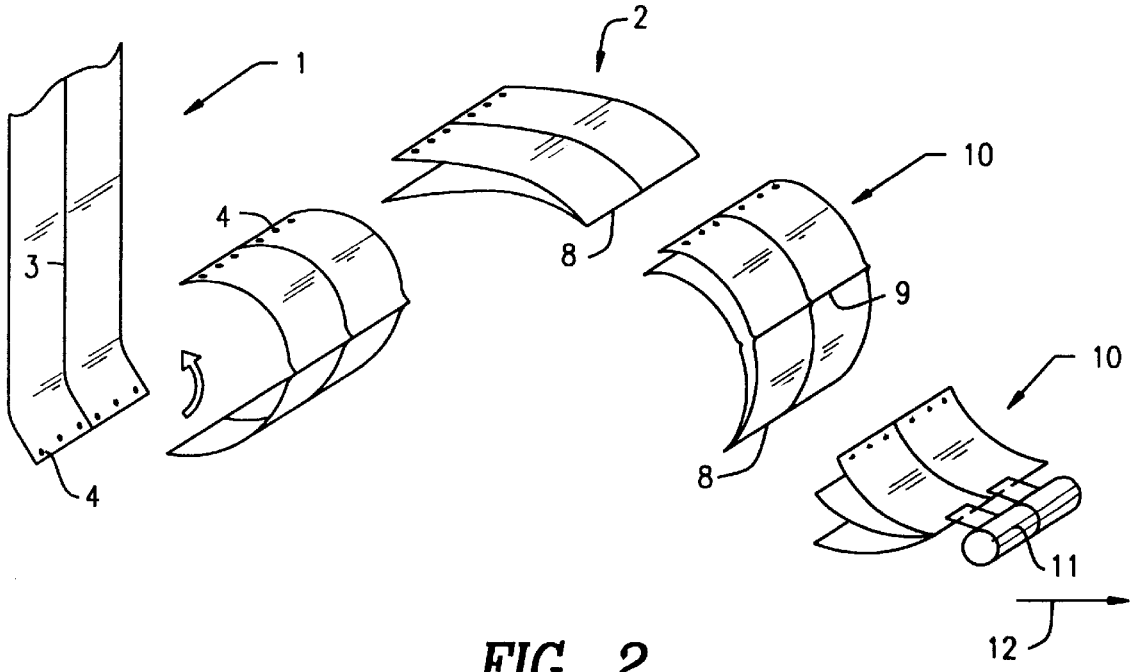
FIG. 2 shows a slit ribbon configuration for a double parallel fold.

FIG. 2 shows a double parallel fold being processed. As already described above, the ribbon 1 is slit longitudinally; the signatures 2 cut from ribbon 1 have pin holes 4 at their trailing edges 6. The signatures 2, which have a first parallel fold 8, are folded again parallel to fold 8, and thereafter have first and second parallel folds 8, 9. The signatures 10, with a double parallel fold, are seized by a gripper device 11, as shown in FIG. 2. The gripper device 11 conveys the seized product—having a tabloid fold (as with signature 7), a double parallel fold (as with signature 10), or any other fold type—in a conveying direction 12, indicated by the arrow. The gripping device seizes the side-by-side products on either side of the slit 3, so that one portion of the product may be held by the gripper device 11, while the other portion is released, as is described below.

Figure 3A:
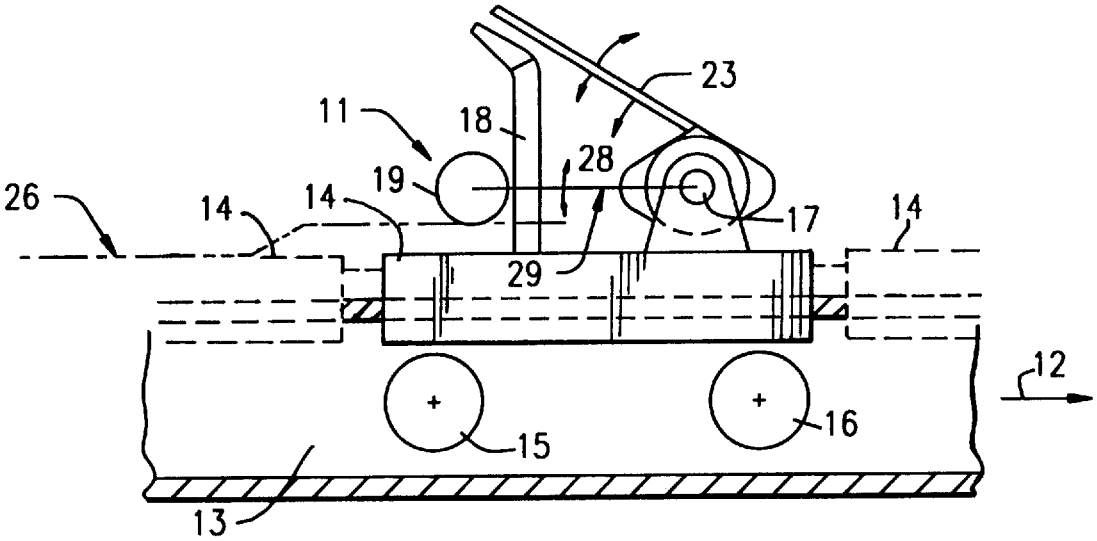
FIG. 3*a* is side view of a first embodiment of a product gripping device on a single conveying track.

FIG. 3*a* is a side view of a product-gripping device mounted on a single conveying track. The gripping device 11 includes a support 14, a first gripper 23, a first pad 18, a first axle 17 and a first cam follower 19 mounted on the axle 17. The first axle 17 is mounted within an axle support 25 and forms the pivoting axis for the first gripper 23. The first gripper 23 is pivotable in a direction indicated by the double arrow in FIG. 3*a*, and cooperates with the first pad 18. The longitudinally-slit sheet-like products are seized between the first pad 18 and the tip of the first gripper 23. The sheet-like products are maintained in position by springs 28, one of which cooperates with first gripper 23 and one of which cooperates with second gripper 24. The first gripper 23 is actuated by the first cam follower 19 mounted on the first axle 17 by way of a lever arm 29. The cam follower 19 is torsionally rigid relative to the first axle 17, so that the axle 17 can be rotated by actuating the first cam follower 19.

Figure 4A:
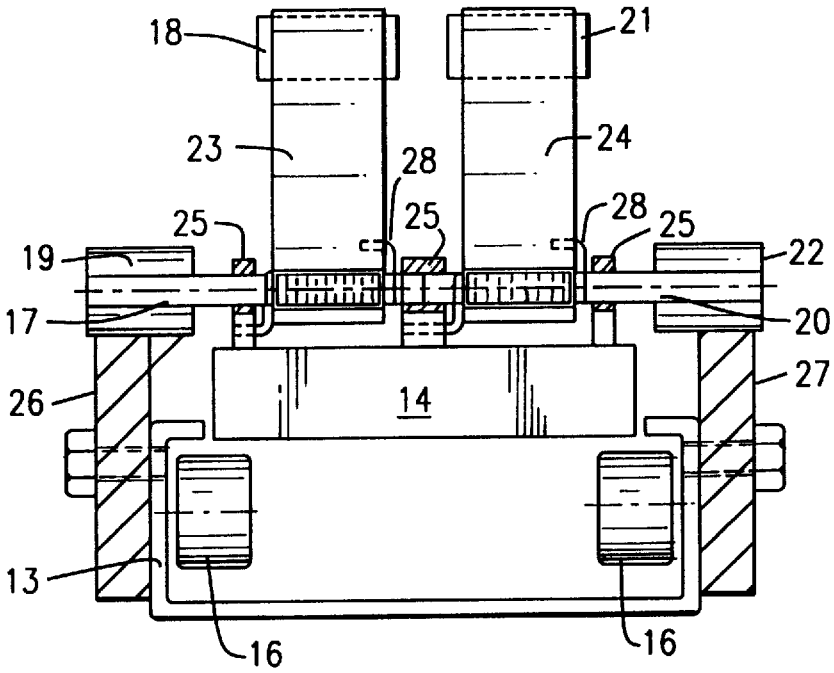
FIG. 4*a* is a front view of a product gripping device of FIG. 3*a*.

A single conveying track, or multiple conveying tracks 13, as shown in FIGS. 3*a* and 4*a*, include multiple disc-shaped first and second rolls 15, 16 mounted within the single conveying track or multiple conveying tracks 13. The first and second rolls 15, 16 are spaced from one another in such a way that the support 14 of the gripping device 11 is always supported by a first roll 15 and a second roll 16. The first and second rolls 15, 16 are rotatably mounted within the single conveying track or multiple conveying tracks 13. The track 13 has an upper opening, the width of which corresponds to the width of support 14 of the gripping device.

All of the first and second rolls 15, 16 within the single conveying track or multiple conveying tracks 13 can be driven by a drive. It is possible to have a friction-reducing material on the surface of the first and second rolls 15, 16 and on the bottom of the support 14 to maintain a continuous movement of the gripping device 11 along the single conveying track or multiple conveying tracks 13.

The single conveying track or multiple conveying tracks 13 can be mounted so as to be inclined relative to a horizontal plane. This arrangement causes the gripping devices 11 to move by the effect of gravity. The gripping devices 11 also can be connected together, as links in a chain (FIG. 3*a*), and driven at one station along the track. In this embodiment, the first and second rolls 15, 16 are mounted rotatably within the single conveying track or multiple conveying tracks 13 and it is only necessary for a few of the rolls 15, 16 to be driven, to compensate for friction losses.

FIG. 4*a* is a front view of the gripping device according to the present invention. By way of axle support 25, first axle 17 and second axle 20 are rotatably mounted on support 14. The first and second axles 17, 20 are mounted coaxially to one another, yet are independently actuatable. Axle 17 has mounted thereon the first gripper 23, and axle 20 has mounted thereon the second gripper 24. The first and second grippers 23, 24 cooperate with the pads 18, 21. Between the first and second pads 18, 21 and grippers 23, 24, tabloid-type or double parallel fold-type signatures, or other products (see FIGS. 1 and 2) may be seized. One half of the signature 2, divided by the longitudinally extending slit 3, is gripped by the first gripper 23, whereas the other portion of the signature 2 is seized by the second gripper 24. Both grippers 23 and 24 are maintained in their gripping positions by torsional springs 28 assigned to each of the axles 17 and 20. Thus, by gripping two portions of a longitudinally slit product, it is possible to release the portions of the product or signature at different release points. As each of the first and second grippers 23, 24 is actuatable independently from the other gripper, a signature can be released in a very simple manner. The first and second cam followers 19, 22 are actuated by a multitude of different types of actuating elements, in as much as only a small amount of rotation is required for a product release. Such a product release is feasible by way of a first cam segment 26 and a second cam segment 27 attached to the single or multiple conveying tracks 13. The first cam segment 26 acts upon the first cam follower 19, while the second cam segment 27 acts independently upon the second cam follower 22. As both cam segments 26, 27 are arranged at different locations on the single or multiple conveying tracks 13, the release of the portions of the longitudinally slit signatures 2 at different locations can be achieved quite simply.

FIG. 4*a* also shows the single conveying track or multiple conveying tracks 13 having an opening, the width of which corresponds to the width of the support 14. The support 14 contacts two second rolls 16 which are mounted within the single or multiple conveying tracks 13 and which rolls 16 are rotatable about the axis schematically indicated in dashed lines.

Figure 3B:
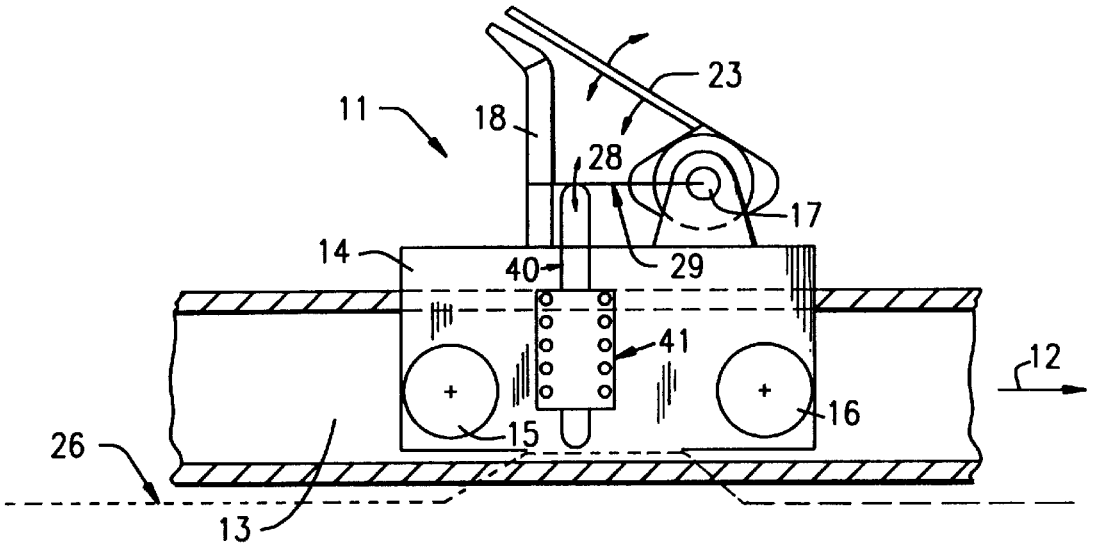
FIG. 3*b* is side view of a second embodiment of a product gripping device on a single conveying track.
Figure 4B:
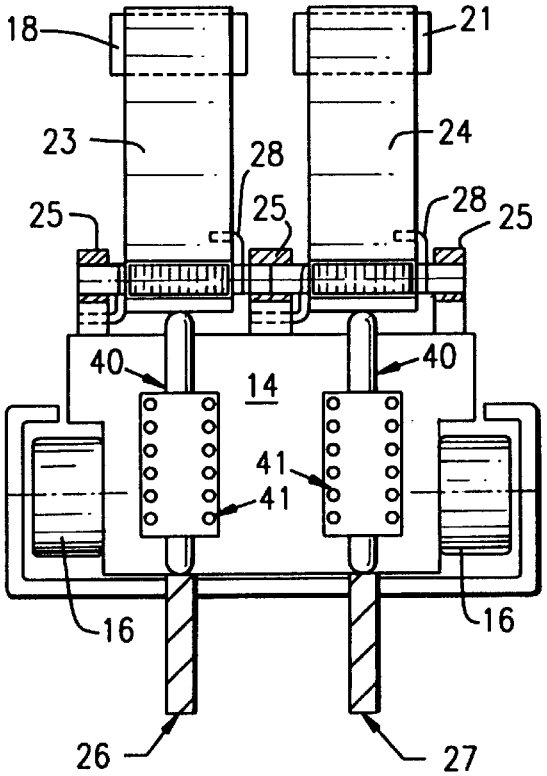
FIG. 4*b* is a front view of a product gripping device of FIG. 3*b;*

FIGS. 3*b* and 4*b* show an alternative embodiment of the device shown in FIGS. 3*a* and 4*a*. In this embodiment, the lever arms 29 are actuated by spring-loaded push rods 40. In this embodiment, the cams 26, 27 are located below the tracks 13 and cause the push rods 40 to move upwardly, against the resistance of springs 41, to thereby open grippers 23, 24. In all other respects, however, the embodiment of FIGS. 3*b* and 4*b* are the same as the embodiment of FIGS. 3*a* and 4*a*.

Figure 5:
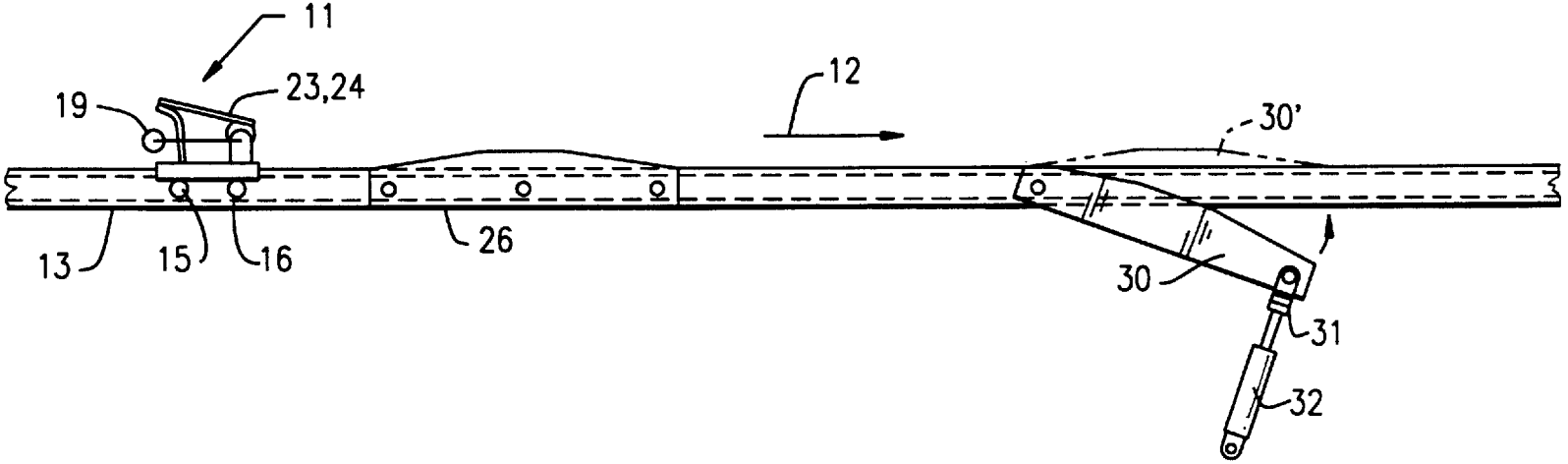
FIG. 5 shows a single or multiple conveying track equipped with fixed and pivotable cam segments.

FIG. 5 shows a single or multiple conveying track arrangement equipped with a fixed and a pivotable cam segment. The gripping device 11, having first and second grippers 23, 24, is moved on the single or multiple conveying tracks 13 in the conveying direction 12. Attached to the conveying track 13 is a fixed first cam segment 26 having two ramps. The ramp arrangement allows for gradual opening or closing of the first gripper 23 to which the cam follower 19 is coupled. By passing the first fixed cam segment 26, the gripper 23 is opened and closed to release one portion of the longitudinally slit signature 2. The same is true of cam 27 and follower 22. It is also possible to provide a pivotable cam segment 30 to act upon the cam followers 19 and 22, respectively. If the release of a product portion is desired at a certain location, the pivotable cam segment 30, which can be on either side or both sides of the track 13, can be moved into its engaged position 30' to act upon the cam follower 19 or the other cam follower 22. In this situation, the first gripper 23 is activated to move against the spring 28 to release the product portion. Movement of the pivotally mounted cam segment 30 is achieved by an actuating unit 32 having an extendable rod member 31. If release of a product portion is not required at a certain predetermined location, the pivotable cam segment 30 stays in its disengaged position.

Figure 6A:
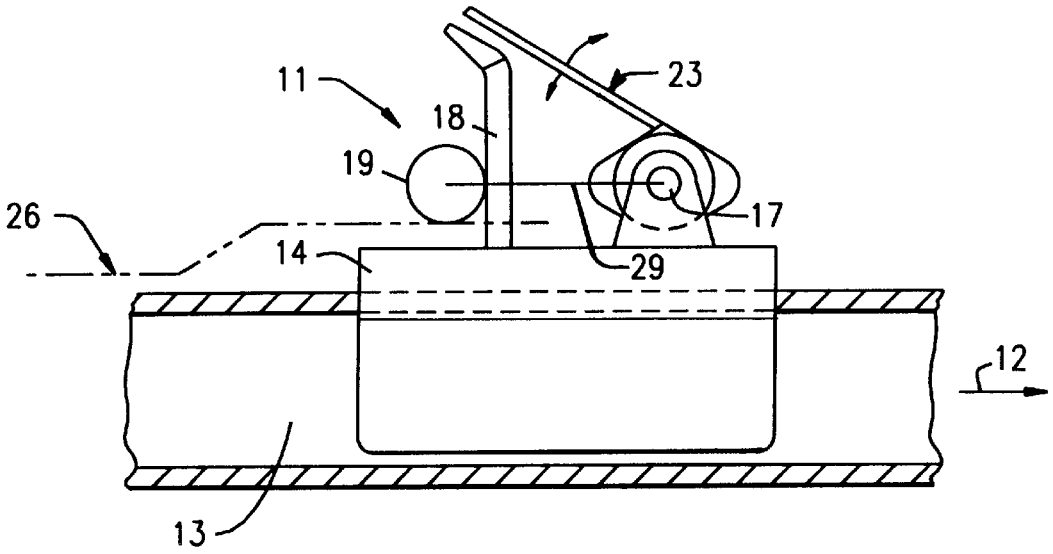
FIG. 6*a* shows a side view of a slidably mounted gripping device.
Figure 6B:
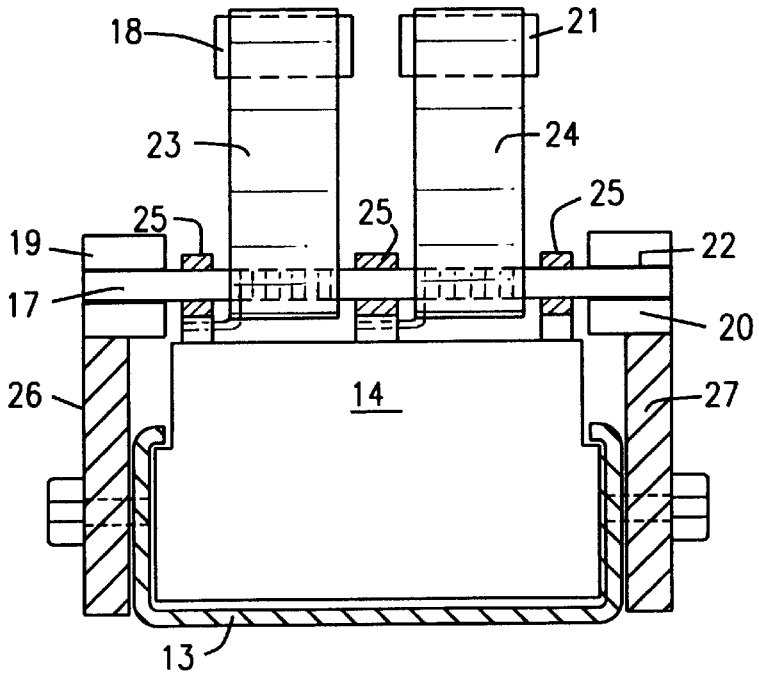
FIG. 6*b* shows a front view of the device of FIG. 6*a*.

FIGS. 6*a* and 6*b* show an alternative embodiment of the device wherein the device is slidably mounted in the conveying track 13. The support 14 slides in track 13.

I claim:

1. An apparatus for gripping and conveying sheet-like products, comprising:

at least one conveying track, said at least one conveying track comprising a first actuating element at a first location on the conveying track and a second actuating element at a second location spaced along the length of the conveying track;

a support supported in and conveyed by said at least one conveying track;

a gripping device mounted to said support for seizing sheet-like products, said gripping device comprising at least a first gripper and a second gripper, said grippers being actuatable independently from one another;

first actuated element operatively connected to said first gripper and a second actuated element operatively connected to said second gripper, said first actuating element actuating said first actuated element and said second actuating element actuating said second actuated element to thereby actuate said first gripper at a location on said conveying track different than a location on said conveying track where said second gripper is actuated.

2. The apparatus of claim 1, wherein:

said at least one conveying track comprises rotatably mounted guiding elements supporting said support.

3. The apparatus of claim 1, wherein:

said grippers are disposed on either side of said gripping device.

4. The apparatus of claim 1, further comprising:

at least one biasing element producing a biasing force maintaining said grippers closed and wherein said actuating elements actuate said actuated elements to thereby overcome said biasing force maintaining said grippers closed.

5. The apparatus of claim 4, wherein:

said first actuated element and said second actuated element are cam followers.

6. The apparatus of claim 3, wherein:

said first gripper and said second gripper cooperate with a first pad and a second pad, respectively.

7. The apparatus of claim 5, wherein:

said cam followers comprise a first cam follower and a second cam follower, said first cam follower being mounted on a first axle, said second cam follower being mounted on a second axle, both said axles being mounted on said support.

8. The apparatus of claim 7, wherein:

said first and second axles are mounted coaxially on said support.

9. The apparatus of claim 7, wherein:

said first axle and said second axle define pivoting axes for said grippers, and wherein said first and second axles are mounted in an axle support.

10. The apparatus of claim 1, wherein:

said at least one conveying track extends in a substantially horizontal plane.

11. The apparatus of claim 1, wherein:

said at least one conveying track is inclined relative to a horizontal plane.

12. The apparatus of claim 1, further comprising:

a plurality of gripping devices, said gripping devices being connected together as a chain.

13. An apparatus for gripping and conveying sheet-like products, comprising:

at least one conveying track;

a support supported in and conveyed by said at least one conveying track;

a gripping device mounted to said support for seizing sheet-like products, said gripping device comprising at least two grippers, said grippers being actuatable independently from one another, said gripping device further comprising at least one biasing element producing a biasing force maintaining said grippers closed;

a first actuated element operative connected to one of said grippers, a second actuated element operatively connected to another of said grippers, and actuating elements which actuate said actuated elements to thereby overcome said biasing force maintaining said grippers closed, wherein said first actuated element and said second actuated element are spring loaded push rods.

14. An apparatus for gripping and conveying sheet-like products, comprising:

at least one conveying track;

a support supported in and conveyed by said at least one conveying track;

a gripping device mounted to said support for seizing sheet-like products, said gripping device comprising at least two grippers, said grippers being actuatable independently from one another, said gripping device further comprising at least one biasing element producing a biasing force maintaining said grippers closed;

a first actuated element operatively connected to one of said grippers, a second actuated element operatively connected to another of said grippers, and actuating elements which actuate said actuated elements to thereby overcome said biasing force maintaining said grippers closed; and an actuating unit, at least one of said actuating elements being movably mounted, said actuating unit moving said at least one actuating element from a first position wherein said actuating element actuates one of said actuated elements to a second position wherein said actuating element does not actuate said one of said actuated elements.

15. The apparatus of claim 14, wherein:

said movably mounted actuating element is pivotally mounted on said at least one conveying track.

16. An apparatus for gripping and conveying sheet-like products, comprising:

at least one conveying track, said at least one conveying track comprising a first actuating element at a first location on the conveying track and a second actuating element at a second location on the conveying track;

a support supported in and conveyed by said at least one conveying track, said support being slidably mounted on said at least one conveying track;

a gripping device mounted to said support for seizing sheet-like products, said gripping device comprising at least a first gripper and a second gripper, said grippers being actuatable independently from one another;

a first actuated element operatively connected to said first gripper and a second actuate element operatively connected to said second gripper, said first actuating element actuating said first actuated element and said second actuating element actuating said second actuated element to thereby actuate said first gripper at a location on said conveying track different than a location on said conveying track where said second gripper is actuated.

17. An apparatus for gripping and conveying sheet-like products, comprising:

at least one conveying track, said at least one conveying track comprising a first actuating element at a first location on the conveying track and a second actuating element at a second location on the conveying track;

a support supported in and conveyed by said at least one conveying track;

a gripping device mounted to said support for seizing sheet-like products, said gripping device comprising at least a first gripper and a second gripper, said grippers being actuatable independently from one another;

a first actuated element operatively connected to said first gripper and a second actuated element operatively connected to said second gripper, said first actuating element actuating said first actuated element and said second actuating element actuating said second actuated element to thereby actuate said first gripper at a location on said conveying track different than a location on said conveying track where said second gripper is actuated; and an actuating unit, wherein at least one of said actuating elements is movably mounted on said at least one conveying track, said actuating unit moving said at least one actuating element from a position where it engages one of said actuated elements to a position where it does not engage said one of said actuated elements.

18. The apparatus of claim 17, wherein:

said movably mounted actuating element is pivotally mounted on said at least one conveying track.

* * * * *